US005142741A

United States Patent [19]

Demuth et al.

[11] Patent Number: 5,142,741

[45] Date of Patent: Sep. 1, 1992

[54] CARDING ELEMENTS WITH VARIABLY INCLINED TEETH FOR WORKING TEXTILE FIBERS AND METHOD

[75] Inventors: Robert Demuth, Nurensdorf; Peter Fritzsche, Winterthur; Eduard Nüssli, Wiesendangen; Paul Stäheli, Wilen bei Wil, all of Switzerland

[73] Assignee: Maschinenfabrik Rieter AG, Winterthur, Switzerland

[21] Appl. No.: 621,979

[22] Filed: Dec. 4, 1990

[30] Foreign Application Priority Data

Dec. 4, 1989 [CH] Switzerland ..... 348/89

[51] Int. Cl.[5] ..... D01G 15/08; D01G 15/24; D01G 15/80

[52] U.S. Cl. ..... 19/113; 19/102; 19/104; 19/114

[58] Field of Search ..... 19/98, 99, 102–104, 19/106 R, 108, 110–114

[56] References Cited

U.S. PATENT DOCUMENTS

| | | | |
|---|---|---|---|
| 2,703,439 | 3/1955 | Dole et al. | 19/112 X |
| 3,605,197 | 9/1971 | Watanabe | 19/114 |
| 3,808,640 | 5/1974 | Graf | 19/113 |
| 3,824,650 | 7/1974 | Watanabe | 19/114 |
| 4,090,276 | 5/1978 | Roberts | 19/114 X |
| 4,291,438 | 9/1981 | Seiki et al. | 19/112 |
| 4,295,248 | 10/1981 | Beneke et al. | 19/113 |
| 4,398,318 | 8/1983 | Ashworth | 19/114 |
| 4,553,288 | 11/1985 | Schneider et al. | 19/114 X |
| 4,606,095 | 8/1986 | Egerer | 19/114 X |
| 4,625,367 | 12/1986 | Sole-Leris | 19/113 |
| 4,651,387 | 3/1987 | Giuliani | 19/114 X |
| 5,031,278 | 7/1991 | Demuth et al. | 19/113 X |
| 5,054,166 | 10/1991 | Demuth et al. | 19/108 X |

FOREIGN PATENT DOCUMENTS

| | | | |
|---|---|---|---|
| 0095519 | 12/1983 | European Pat. Off. | 19/98 |
| 195756 | 9/1986 | European Pat. Off. . | |
| 1106653 | 11/1957 | Fed. Rep. of Germany | 19/113 |
| 3333618 | 4/1985 | Fed. Rep. of Germany . | |
| 3538447 | 5/1986 | Fed. Rep. of Germany . | |
| 3618801 | 12/1987 | Fed. Rep. of Germany | 19/114 |
| 665892 | 9/1929 | France . | |
| 1493015 | 7/1967 | France | 19/114 |
| 0462771 | 1/1971 | Japan | 19/114 |
| 4631811 | 9/1971 | Japan | 19/114 |
| 0467349 | 2/1969 | Switzerland | 19/114 |
| 0013491 | 2/1851 | United Kingdom | 19/112 |
| 0015155 | 8/1900 | United Kingdom | 19/114 |
| 0006425 | 3/1909 | United Kingdom | 19/112 |

OTHER PUBLICATIONS

Standard Search Report-Europe.

*Primary Examiner*—Werner H. Schroeder
*Assistant Examiner*—Ismael Izaguirre
*Attorney, Agent, or Firm*—Burns, Doane, Swecker & Mathis

[57] ABSTRACT

A method and apparatus for cleaning or carding textile fibers between a fine cleaning or carding drum (2) with clothing (7) fixed thereon and carding elements (5) surrounding said drum, a clothing (9, 10, 11, 12, 13, 14) also being provided thereon. The teeth (9, 10, 11, 12, 13, 14) of the carding elements (5) are so provided differently in the direction of movement (8) of the rotating drum (2) that the tooth (9), for example, has what is known as a negative carding direction with a relatively large angle ($\alpha$) and the tooth (14) a positive carding direction with a relatively small angle ($\alpha$) and the teeth therebetween have different attack angles as shown in FIG. 3. This gives different cleaning or carding effects within a predetermined peripheral zone of the drum.

19 Claims, 6 Drawing Sheets

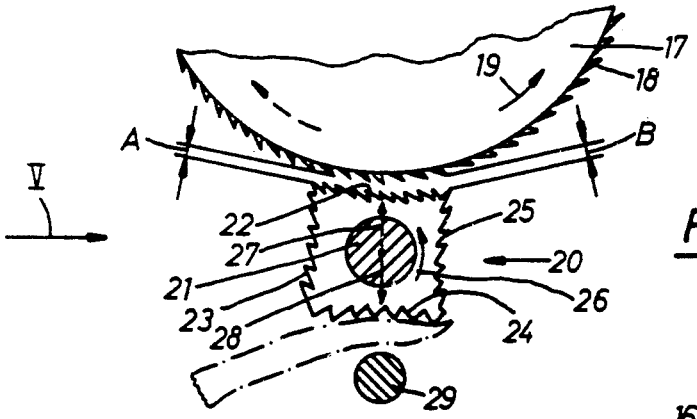
Fig. 4
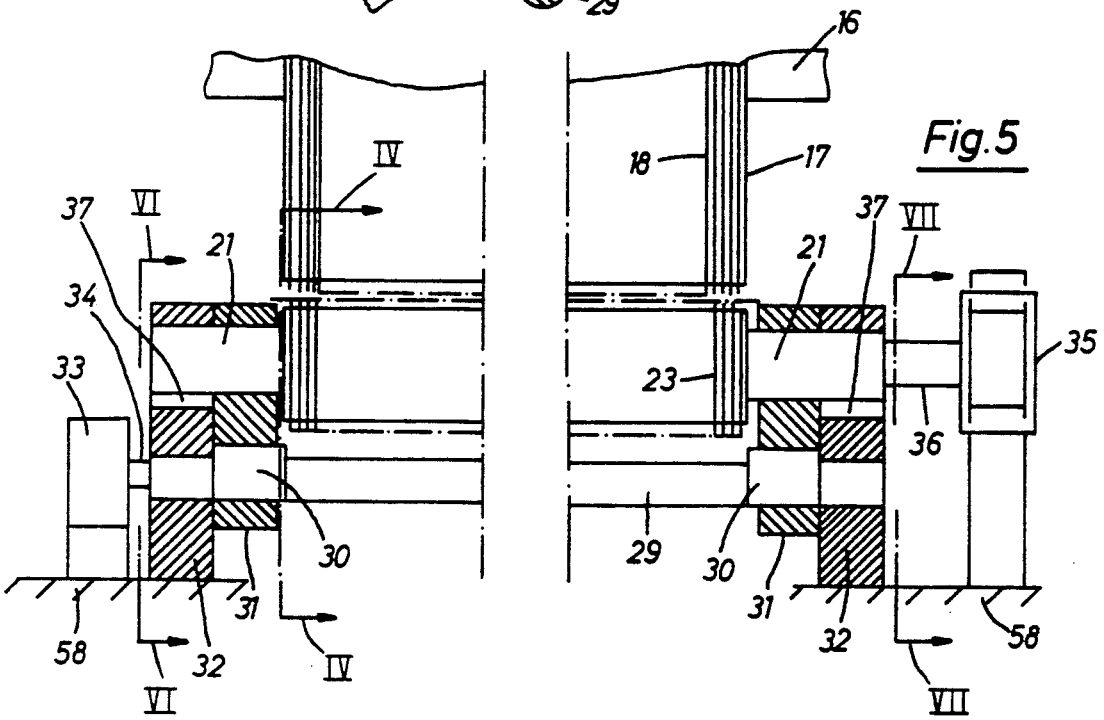
Fig. 5
Fig. 6
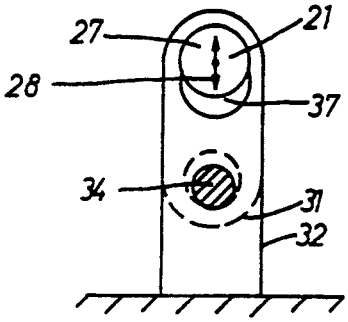
Fig. 7
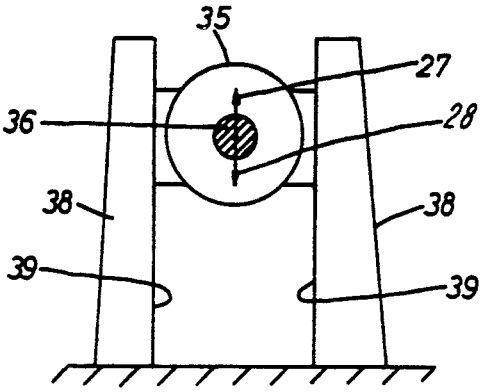

Fig.11
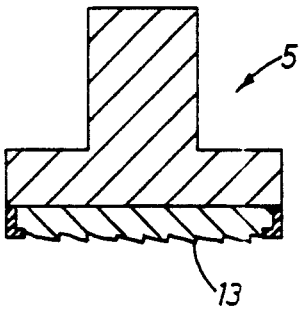
Fig.14
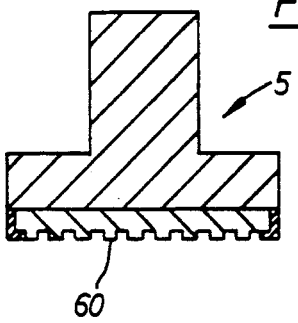
Fig.12
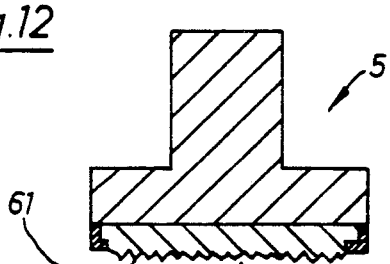
Fig.15
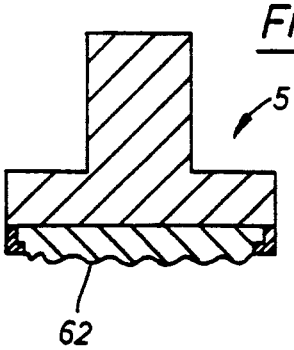
Fig.13
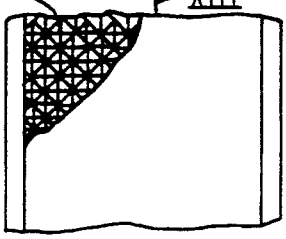
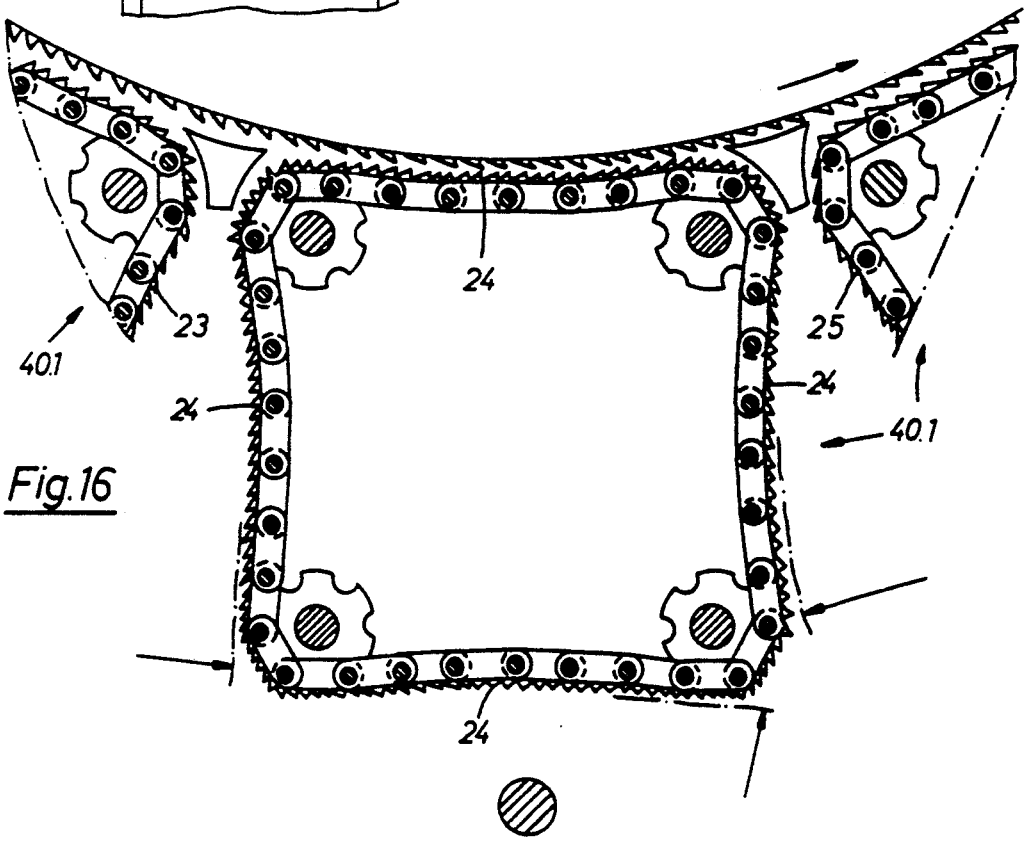
Fig.16

CARDING ELEMENTS WITH VARIABLY INCLINED TEETH FOR WORKING TEXTILE FIBERS AND METHOD

CROSS-REFERENCE TO THE RELATED APPLICATION

This application claims the priority of Swiss Application No. 387/89-7 filed Dec. 4, 1989, which is incorporated herein by reference.

BACKGROUND OF THE INVENTION

1. Field of the Invention

The invention relates to methods and apparatus for cleaning or carding textile fibers between a rotating cleaning or carding drum having clothing thereon and carding elements which surround the drum and also have clothing. It is concerned particularly with the interaction of the clothing teeth carried by the relatively movable components and the effects produced thereby on the quality of the fibers.

2. Description of the Related Art

The developments which have taken place in cleaning and carding machines used in the cotton spinning industry and carding have continued to seek increases in quantity of output without sacrificing yarn quality. The requirements with respect to the uniformity and cleanliness of card slivers and with respect to yarn strength have remained unchanged or even increased.

However, increases in machine output could ordinarily be expected to be accompanied by a certain amount of fiber deterioration, because of an increase in fiber treatment severity. An increase in output makes it necessary to increase the speed of the working drums (e.g. the cleaning drum in a fine cleaning machine and the speed of the swift in a card) which have toothed clothing for gripping the tufts from the upstream feed elements and cleaning and parallelizing the fibers through additional opening and carding.

Some efforts have been made to cultivate cotton species which are better adapted to modern requirements. However, the increase in machine output capability has been much more rapid than the change in the product to be processed.

In other words, the randomly oriented fibers in the fiber tufts have to be parallelized faster now by the tips of conventional clothing. Without additional steps, this would result in increased damage to the staple. The desire, however, in the cleaning and carding of fibers is towards speeding up operation without actually increasing the damage to the staple.

As is also known, the requirements on the end product, i.e. the yarn, depend on the subsequent processing, and consequently it must be possible so to choose the mixtures of cotton in the blowroom that the intensity of working is with advantage, variable during subsequent processing after the bales have been opened, i.e. during cleaning and carding.

In Swiss application number 04103/88-3 (corresponding to U.S. patent application Ser. No. 07/430,164), the owner of the present invention has already proposed steps in this direction for adapting the intensity of cleaning on the card. In another Swiss application number 02312/89-9 (U.S. patent application Ser. No. 07/540,777), the disclosure of which is incorporated herein by reference, there is shown and described the possibility of varying the intensity of carding by varying the aggressiveness of the clothing on carding elements disposed around the carding drum.

Another commonly owned Swiss application No. 1929/89-1 (corresponding to U.S. patent application Ser. No. 07/524,744) relates to a method of optimizing the processing of cotton in a spinning mill as regards throughput.

Accordingly, steps have already been proposed for adapting to changing end product requirements, i.e. changing yarn requirements, and the possibility of obtaining various feeds by altering the mixture.

Another factor is that the difficulty of converting fibers from random orientation, e.g. in a tuft, to parallel orientation increases with the speed at which the change in orientation is carried out, because rapid engagement (e.g. of clothing in random orientation) is more likely to result in neps than is slow engagement.

It is desirable, therefore, that the interaction between clothing on a rotating drum co-operating with clothing on carding elements be such that the fiber orientation can be altered at high speed with substantial avoidance of neps and damage to the fiber. One practical though not completely relevant example explaining the foregoing is the process of untangling string manually using the fingers, something which of course can be achieved only by careful and considered action, whereas a tangle abruptly torn apart will result in a number of individual tangles which are impossible or much more difficult to unravel.

SUMMARY OF THE INVENTION

The invention provides methods and apparatus features which can be used toward solving such problems. In one aspect of a method according to the invention, the cleaning or carding effect varies within a given peripheral region of the drum, and is preferably so devised that the opening effect increases in the direction of rotation of the drum (i.e., in the fiber transport direction).

The peripheral region in which the opening effect increases can—as considered in the direction of drum rotation—follow a place where a random orientation of the fibers occurs on the drum. The invention is of particular importance in a card, more particularly in the area which—as considered in the direction of rotation of the swift—follows the doffer, i.e. the undergrid zone, but also in the region following the licker-in, i.e. the precarding zone. The same advantages, however, can be obtained in a cleaning machine (more particularly a cleaning machine with a sawtooth clothing) if use is made of the principle of increasing intensity for opening a random orientation of the fibers on the working roller.

The intensity of fiber processing can advantageously increase gradually (continuously or quasi-continuously) in the direction of drum rotation. Where the clothing is fitted by means of individual clothing carriers (e.g. bars or rods or segments), the intensity can increase from one carrier to the next.

Where the intensity is determined by the working angle (the "breast angle") of the clothing, the angle can vary, within the peripheral region, from a negative value to a positive value.

The intensity of processing is normally achieved by changing the structure of the clothing carried by the drum covering.

An important advantage that can flow from the invention is that, in the working region for correcting the fibers from random to parallel orientation, the intensities of aggression of the clothing can be so varied that the random orientation is first tackled with a gentle carding effect, then tackled more energetically when the random orientation has already been partly unravelled.

As a result of this gradual increase in carding intensity, the fibers can be converted from a random to a parallel orientation with substantial avoidance of neps and damage to fibers, even at high speeds.

BRIEF DESCRIPTION OF THE DRAWINGS

The invention will be described in greater detail hereinafter with reference to exemplary embodiments shown in the following drawings:

FIG. 4 shows another form of equipment for the invention, the view being taken on the section line IV—IV (FIG. 5);

FIG. 5 shows the subject of FIG. 4 in the direction of arrow V (FIG. 4);

FIG. 6 shows a detail of FIG. 5 in the direction of the arrow on the section line VI—VI;

FIG. 7 shows a detail of FIG. 5 on the section line VII—VII (FIG. 5);

FIGS. 11, 12, 14 and 15 each show a component useable in FIG. 1 in section and to an enlarged scale;

FIG. 13 is a view of the element in FIG. 12, seen in the direction XIII;

FIG. 16 shows another application of the variant of FIG. 9; and

DESCRIPTION OF PREFERRED EMBODIMENTS

Figure 1:
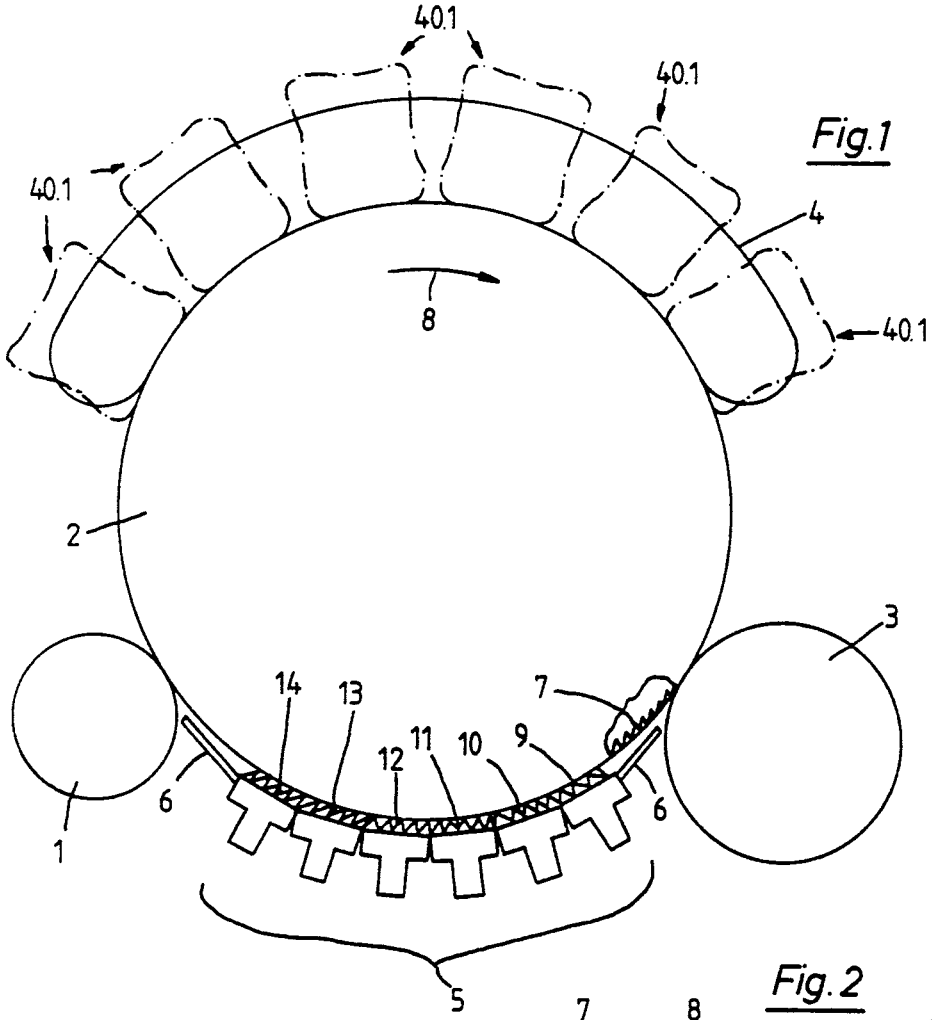
FIG. 1 is a diagrammatic cross-section through a card.

FIG. 1 is a diagrammatic section through a card comprising a licker-in 1, a swift 2, a doffer 3 and revolving flats 4. In such a card, a distinction is drawn between a precarding zone, a carding zone, an aftercarding zone and an undergrid. The precarding zone extends between the licker-in 1 and the flats 4. The carding zone extends over the flats zone. The aftercarding zone is bounded by the flats 4 and doffer 3. The undergrid is disposed between the doffer 3 and the licker-in 1. The swift rotates in a direction 8. The directions in which the other elements rotate have been omitted for the sake of simplicity.

Disposed in the undergrid zone are six diagrammatically represented stationary carding elements 5. Disposed on the left and right thereof as viewed in FIG. 1 are cover plates 6 which so cover the otherwise open places of the swift 2 that fibers disposed thereon cannot be hurled outwards by centrifugal force.

Figure 2:
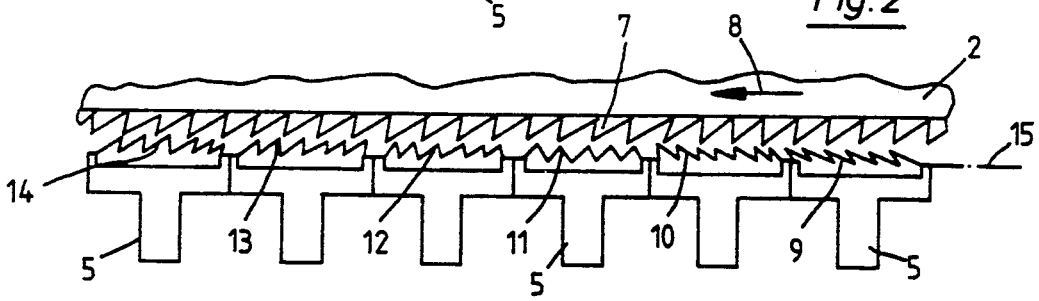
FIG. 2 is a view to an enlarged scale of a part of FIG. 1 in a straightened-out form.

FIG. 2 is a view in a purely diagrammatically straightened or developed arrangement of the stationary carding elements 5 of FIG. 1—i.e., the carding elements are disposed in adjacent in-line relationship to one another. Also shown in developed form is part of a swift clothing 7. The developed illustration of the stationary carding elements 5 and swift surface 2 is symbolized by a chain-dotted straight line 15.

Figure 3:
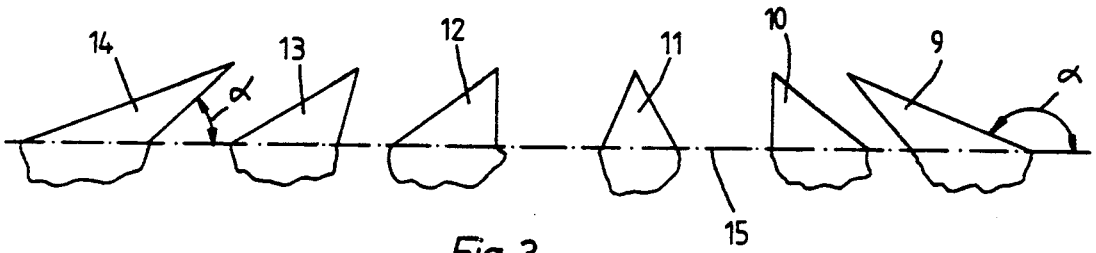
FIG. 3 shows diagrammatically individual parts from components of FIG. 2 to an enlarged scale.

As FIG. 3 shows, the line 15 is also the base line for the teeth, to be described hereinafter, of the clothing elements, to be described hereinafter.

The clothing elements of the stationary carding elements 5 are shown in FIG. 1 but to a small scale and are therefore shown to an enlarged scale in FIG. 2.

As FIG. 2 shows, each of the stationary carding elements 5 has a different clothing element, viz. clothing elements 9 to 14. Clothing element 9 has, relatively to the direction of rotation of the swift clothing 7, a negative direction at a relatively large angle $\alpha$ (see FIG. 3), while the final clothing element 14 as considered in the direction of rotation 8 has a tooth which extends in the opposite direction from the tooth of the element 9 and therefore has a much smaller angle $\alpha$.

The angle $\alpha$ of the clothing element 9 might be described as a negative carding inclination, and the angle $\alpha$ of the clothing element 14 as a positive carding inclination, of the tooth tips of the clothing elements 9 to 14.

Further tips of the clothing elements 10 to 13 are disposed between the tips of the clothing elements 9 and 14. As will be apparent, the angle $\alpha$, which is shown only for the clothing elements 9 and 14, decreases continuously from the element 9 to the element 14 so that the elements 12–14 can be regarded as positive clothing elements and the elements 9–11 as negative clothing elements. A change of clothing within any one element 5 would be theoretically possible but has proved too complex in practice.

However, the term "negative clothing element" is not to be understood as denoting a clothing element having a negative effect, the term having been chosen merely for the sake of simplicity to differentiate between, on the one hand, the clothing elements 9 to 11 and, on the other hand, the clothing elements 12 to 14.

The underlying technological idea behind the choice of tooth directions shown in FIG. 3 is that after passing the doffer the fibers are again in a random orientation, so that an initially gentle treatment by the clothing element 9 starts and the fibers are then subjected to an increasingly intense treatment with the clothing element 14 finally providing the most intensive treatment.

This feature substantially embodies the idea previously mentioned of random fiber orientations being broken up gently by the card—i.e., fibers which are not completely parallel are opened so carefully that nep formation is substantially avoided but the fibers can still be parallelized.

The angle $\alpha$ can be between 130° and 50°. The remaining drawings will be described hereinafter, bearing in mind that FIGS. 4–10 and 17 have already been described in the commonly owned Swiss patent application No. 01 312/89-9, the disclosure of which is incorporated herein by reference. Hence, only the main points affecting the underlying idea of the invention will be repeated herein.

Similar considerations apply to FIGS. 11 to 16, which have already been described in the commonly owned Swiss patent application No. 04 103/88-3, (corresponding to U.S. patent application Ser. No. 07/430,164) the disclosure of which is incorporated herein by reference. Hence, the present description has been correspondingly limited to the use of these elements in connection with the invention.

According to the invention, rotatable carding elements 20, only one of which is shown in FIG. 4, can be provided instead of the stationary carding elements 5.

The carding elements 20 are of polygonal cross-section and are rotatable in a direction 26 around a shaft 21 and can be secured in various positions so that a selected one of the clothing elements 22 to 25 may be disposed opposite the clothing element 18 of a swift 17. These positions can each be varied to the extent that the gap A and gap B can be adapted to requirements—i.e., e.g. the gap A can be larger than the gap B in order to enhance the carding effect in a particular position.

The clothing elements can vary according to requirements but can be such, for example, that the clothing element 23 corresponds to the clothing element 9 of the stationary carding element 5, the clothing element 24 to the clothing element 11, the clothing element 25 to the clothing element 13 or 12 and the clothing element 22 to the clothing element 14 of the carding element 5.

When, for example, and as already mentioned, more than one rotatable carding element is provided, a clothing element combination can be selected which corresponds basically to the combination of FIGS. 1 to 3, with the advantage that the combination can be varied by rotation of the carding elements 20.

FIG. 5 shows the elements of FIG. 4 as seen from the direction of arrow II (FIG. 4), and contains further details in order to show how the carding element 20 can be devised to be rotatable.

Reference should be made in connection with this Figure to the earlier mentioned application CH 1312/89, except that like elements have new references, and so the various elements will be described again.

A shaft 16 rotates swift 17 and by way of a shaft 34 a servomotor 33 rotates an eccentric shaft 29 carrying two eccentrics 30 each receiving an eccentric bearing member 31. The bearing member 31 is also effective for the rotatable mounting of a shaft 21 so guided in slots 37 (FIG. 6) in a support 32 that the movements 27, 28 indicated by arrows can be executed (see also FIGS. 4 and 7). These latter movements are executed by the eccentric 30.

The rotatable carding element 20 is rotated by a servomotor 35 which is guided between guide surfaces 39 for movement in directions 27, 28 and which is connected by way of shaft 36 to the shaft 21 of the rotatable element 20.

By way of a control (not shown) the two servomotors 33, 35 can be triggered to select a desired combination of the clothing elements such as is shown, for example, in FIG. 1. Alternatively, however, and as shown by the previous application CH-1312/89-9, the polygonal cross-section may have six clothing surfaces, and so more clothing element variations are possible than are shown in FIG. 4.

Another possibility is for rotatable carding elements 20 of this kind to be provided not only in the undergrid but also in the precarding zone and aftercarding zone and possibly, even if the revolving flats zone is shortened, in the carding zone.

Figure 8:
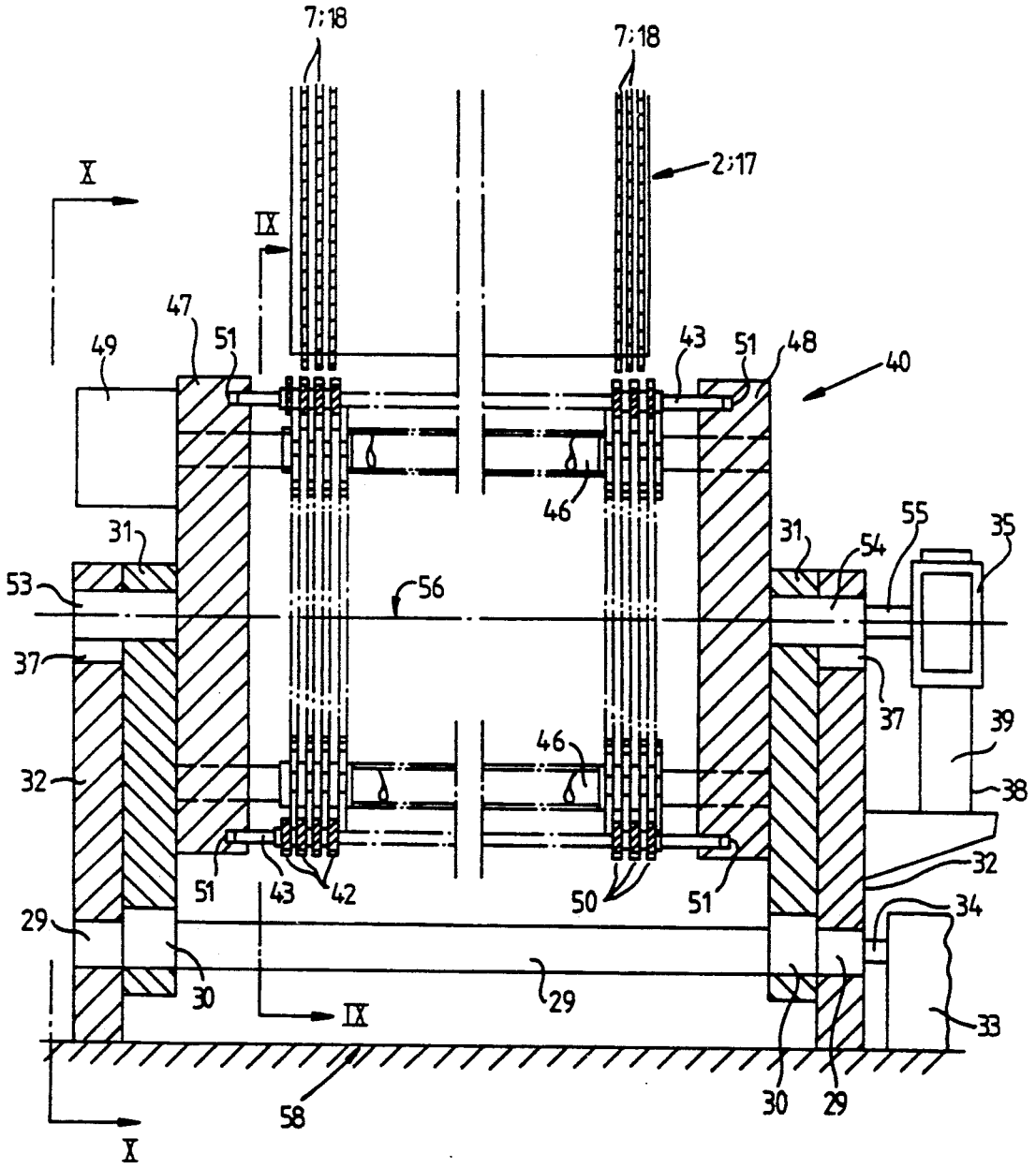
FIG. 8 shows a section through another form of equipment suitable for the invention.
Figure 10:
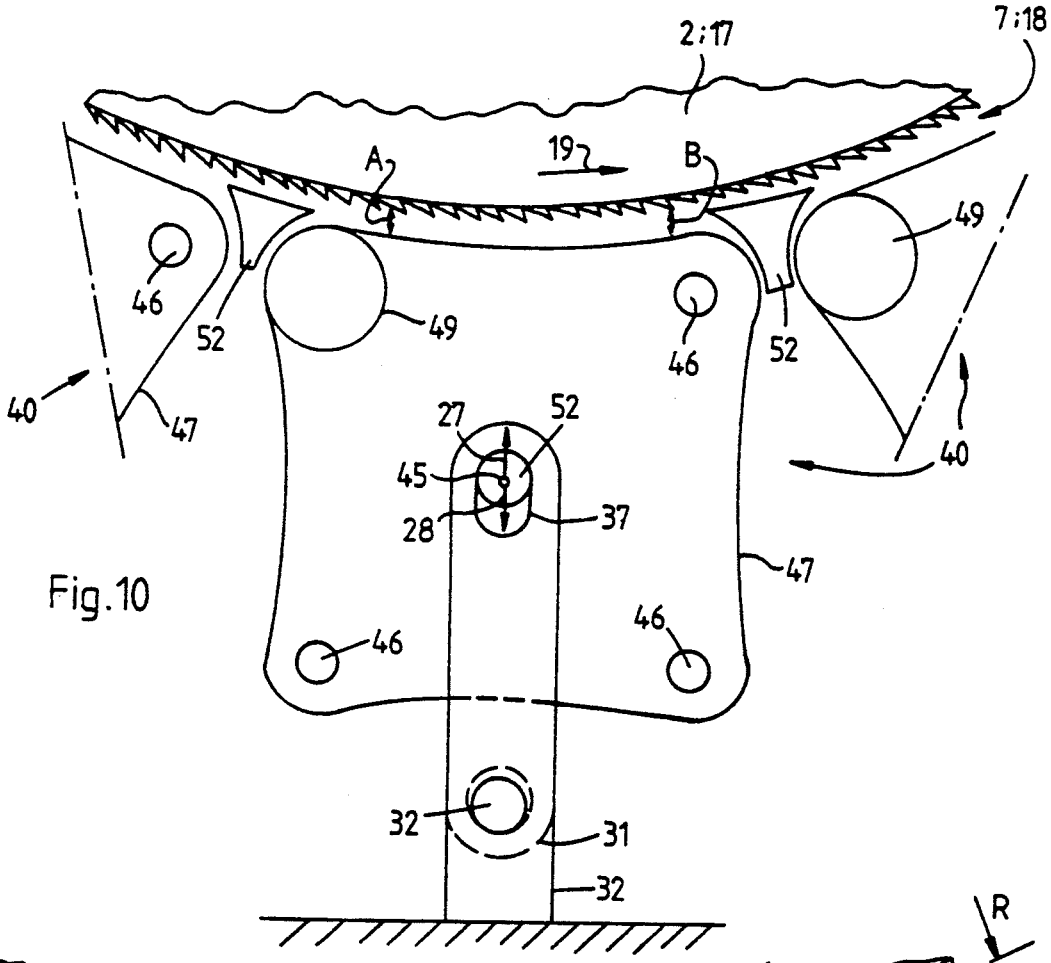
FIG. 10 shows another variant of the invention in elevation on the line X—X (FIG. 8)
Figure 9:
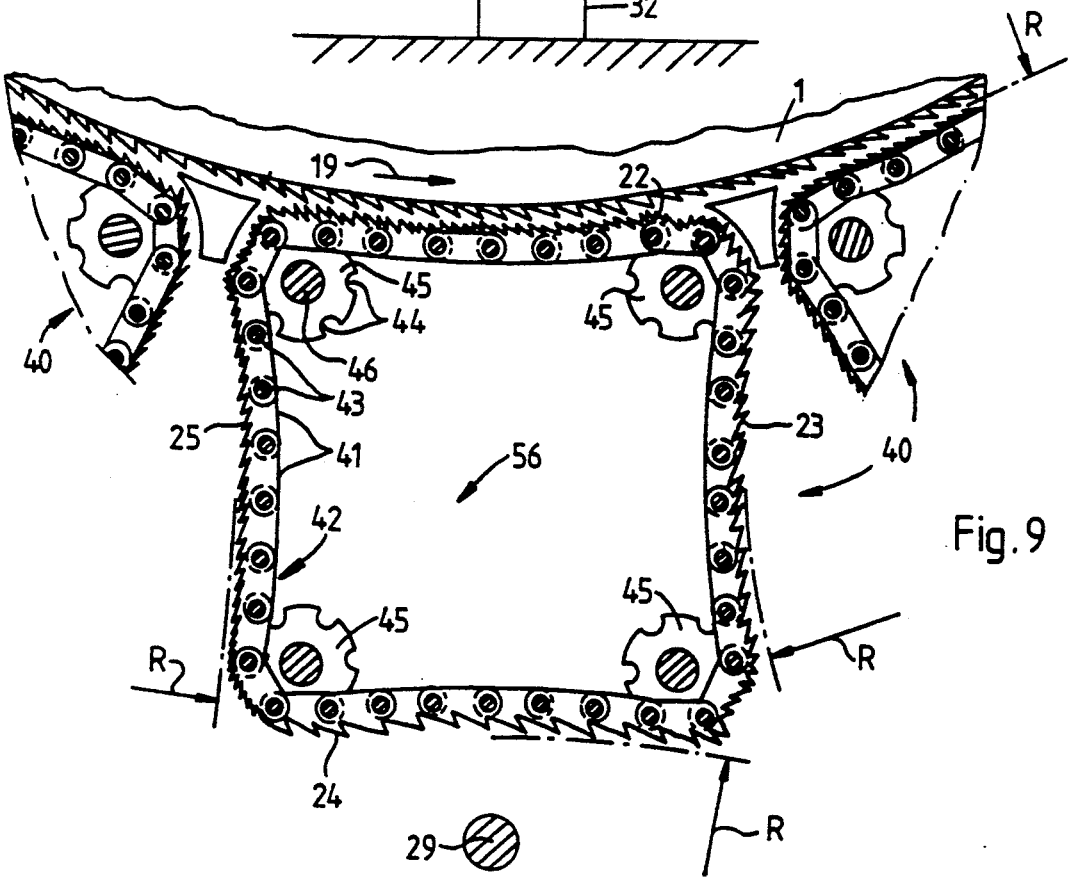
FIG. 9 shows the subject of the invention of FIG. 8 in section on the line IX—IX (FIG. 8)

FIGS. 8–10 show another variant of a carding element 40 in which the clothing elements are not a part of a fixed clothing strip but are part of a chain link 41 (FIG. 9). However, the clothing elements, since they may be the same as are shown in FIGS. 4 and 5, have the same references.

Through the agency of chain link pins 43 which extend axially through the carding element 40 the links 41 form a chain 42. Tubular spacers 52 (FIG. 8) which are also drawn on to the pins 43 are disposed between the various chains 42.

The spacers 52 are received in grooves 44 of sprockets 45 as in the case of a bicycle chain.

The sprockets 45 are disposed on a continuous shaft 46 in each case at a specific distance (not indicated) from one another so that the sum of all the chains 42 forms the actual carding element 40. However, there may be only two such shafts 46 provided so that only two different clothing elements can be provided.

The shafts 46 are mounted at both ends in a respective bearing plate 47, 48, one of the shafts being connected to a servomotor 49. The same is shown purely diagrammatically in FIGS. 8 and 10. The other three shafts, which are not driven separately by a servomotor, are driven by way of the chains 42.

Also, each pin 43 is guided at its free end by a groove 51 in the respective plate 47, 48, the groove 51 being endlessly rotating of the kind such that the chain 42 forms a curvature which has a radius R (FIG. 9) and which is indicated diagrammatically in chain-dotted lines. As FIG. 9 shows, the curvature is the same for the clothing elements 22 to 25 and corresponds to a curvature R concentric of the rotational axis (not shown) of the roller 2, 17 to the extent that the distance between the clothing element 7, 18 of the roller 2, 17 respectively and whichever clothing element of the carding element 40 is in operation is equal over the entire longitudinal part to the peripheral length of the clothing element.

Also, guides 57 can be provided for each chain part (shown only for one such part in FIG. 9) having a different clothing element, the guides 57 being supported by the pins 43 when taking up the pressure caused by radial forces.

As will be apparent from FIGS. 9 and 10, more than one carding element 40 can be provided. These Figures also show that a web-guiding element 52 is provided before and after a carding element 40 or between two such elements 40, the web-guiding element 52 ensuring that the web present on the clothing element 7, 18 of the respective roller 2, 17 is not hurled away between two carding elements 40 by the centrifugal force which the web experiences as the roller 2, 17 rotates but is supplied to the next carding element 40.

As FIG. 10 shows, each carding element 40 can be moved in the directions 27, 28 and move in the direction of rotation. The purpose of these linear movements and of this rotation is the same as described for the carding element 20, and so the same references are used for these movements.

To produce the two linear movements 27, 28 the bearing plate 47 has a spindle 53 and bearing plate 48 has a shaft 54. Both of them—i.e., the spindle 53 and shaft 54, are fixedly arranged to be coaxial of rotational axis 56 of the respective bearing plates 47, 48.

The means for producing the linear motions 27, 28 and the rotation 26 of an individual carding element 40 correspond to the means described and shown mainly in connection with FIGS. 4 to 7, and so the latter means have the same references except that what is connected to the servomotor 35 is the prolongation 55 of shaft 54.

Each of FIGS. 11 to 15 shows a stationary carding element 5, the element 5 of FIG. 11 having a clothing element 13 previously shown whereas FIGS. 12 to 15 show clothing element variations. For example, FIGS. 12 and 13 show a milled or knurled surface 61, FIG. 14 a grooved surface 60 and FIG. 15 a wavy surface 62.

The various kinds of clothing element are used on the basis of empirical tests.

FIG. 16 shows the use of the device of FIGS. 8, 9 and 10 in the sense that each mobile carding element 40.1 has the same clothing element over its entire periphery but the adjacent carding elements have different clothing elements. Such carding elements can therefore be used, for example, instead of or in addition to revolving flats or anywhere on the swift periphery to provide the following possibilities:

A. The clothing elements can have an action which intensifies as considered in the direction of swift rotation;

B. The clothing elements can move continuously in one and the other direction and at a different speed;

C. The gaps A and B (FIG. 4) can differ from one another;

D. Features A to C can be combined in a variable form.

Figure 17:
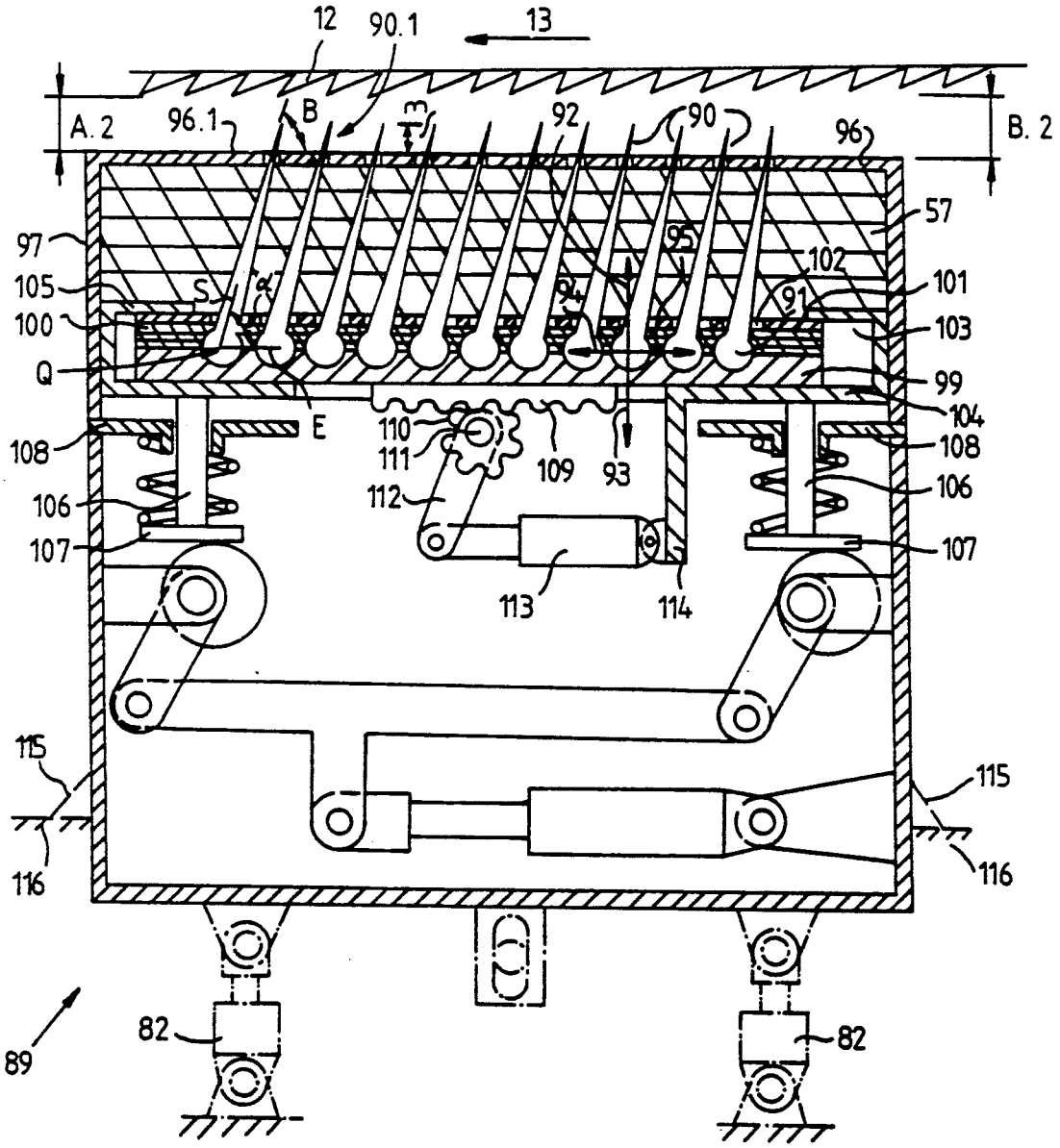
FIG. 17 shows another form of component which can replace the forms of FIGS. 11 to 15.

FIG. 17 shows a carding element 89 which is another variant of a carding element according to the invention and with a movable clothing element 90. Each pin of element 90 has a pin base 91 which receives from the means previously mentioned a linear vertical reciprocation 92, 93 as considered with reference to FIG. 17 and a reciprocation 94, 95, as considered with reference to FIG. 17.

The pin tips of the clothing element 90 project by a predetermined distance M from a top wall 96 of a casing 97 which extends over card width and which is rod-like as viewed externally.

The vertical reciprocation 92, 93 of the pin bases 91 automatically varies, with a variation of the distance M, an attack angle $\beta$ between pin wall 90.1 and surface 96.1 of casing wall 96 at an inclination angle $\alpha$ less than or greater than 90°. The inclination angle $\alpha$ is formed by a symmetry line S of the pin 90, the line S intersecting the pivoting axis Q of the pin base 91, and by an imaginary plane E which contains the pivoting axes Q.

The additional reciprocation 94, 95 and simultaneous vertical reciprocation 92, 93 enables the attack angle $\beta$ to be varied while the distance M remains constant or conversely enables the distance M to be varied while the angle $\beta$ remains constant.

To this end the pin base 91 has, if circular pins—i.e., conical pins—are used, a spherical shape and, if flat pins which are punched out of a metal plate and which have a tapering shape are used, a discoid shape.

Irrespective of whether the base 91 is spherical or discoid the pin base is in both cases embedded in longitudinal grooves as considered lengthwise of a carding element, such grooves having the companion shape to the pin base and being part of a base plate 99. Of course the length of a carding element extends perpendicularly to the surface of the blade of FIG. 17—i.e., the base plate 99 is formed with as many adjacent and parallel longitudinal grooves as there are pin bases transversely of the base plate.

For retention in the grooves 98 the pin bases are covered by a rubber mat 100 in which the pins engage effectively and by a rigid plate 101. The same can be, for example, a metal or rigid plastics plate but must be formed with apertures 102 in which the various pins of the clothing element 90 are free to move in order to take up the various positions. The rubber mat 100 need not be formed with an aperture corresponding to the aperture 102 since the rubber mat is so soft that the material adapts itself to the movements of the pins without experiencing substantial or disturbing changes.

The base plate 99, rubber mat 100 and cover plate 101 together form a single unit of predetermined thickness, the unit being guided between two guide surfaces 103, 104 for displacement in directions 94, 95.

The guide surfaces 103, 104 are parts of a displacing element 105 which has push rods 106 distributed over the length of the element 105 for vertical displacement in directions 92, 93, a push rod plate 107 being fixedly disposed at the free end of each of the push rods 106.

The whole operates similarly to the displacement of the push rods 59 of the carding element 3.3 of FIG. 11 of Swiss patent application 02 312/89-2 and so the other elements for moving the push rods have the same references and will not be described in further detail. Similar considerations apply to the sponge rubber mat 57 between the element 105 and the casing wall 96.

One guide plate 108 each is provided to guide the push rods 106 as a component of the casing 97.

To move the base plate 99 in the direction 94, 95 the base plate 99 has a toothed rack 109 at each of its two longitudinal ends, each such rack being rigidly connected to the base plate 99.

Meshing with each tooth rack is a gear 110 connected to a shaft 111 to co-rotate therewith.

For its rotation the shaft 111 is connected to a rocking lever 112 to co-rotate therewith, the lever 112 being pivotally connected at its free end to a servomotor 113 pivotally disposed on a bracket or the like 114 which is a part of the element 105.

The shaft is also rotatably mounted in brackets (not shown) which are a part of the element 105.

The distance (not shown) between the two toothed racks is such that the displacing moment of each gear acts as far as possible in the end zone in each case as considered lengthwise of the base plate—i.e., perpendicularly to FIG. 17.

The casing 97 can either be disposed, as in the case of the supports 115 shown in chain-dotted lines, non-displaceably on a non-displaceable machine part 116 or, similarly to FIG. 12 of the Swiss patent application previously referred to, have servomotors 82 so that the distances A.2 and B.2 can be adjusted, as described with reference to FIG. 12 of application CH 2312/89.

The elements necessary for this purpose therefore have the same references as FIG. 12 of application CH 2312/89 since they operate in the same way and for the same purpose.

Variable adjustability of the carding elements 5 by gaps A and B as shown in FIG. 4 is illustrated and described in European patent specification No. 0 195 756 and U.S. patent application Ser. No. 4,286,357, the disclosure of which is incorporated herein by reference.

For the possible use of this invention in a cleaning machine, reference should be made to our Swiss patent application No. 3452/89-8 of Sep. 21, 1988 ("Method and apparatus for the fine cleaning of textile fibres"), corresponding to U.S. patent application Ser. No. 07/585,985, the disclosure of which is incorporated herein by reference. FIG. 5 of Application No. 3452/89 shows a carding plate and FIG. 7 of the same application shows a general arrangement comprising said carding plate.

The carding plate (or combing segment) of Application CH 3452/89 can also be provided with a clothing or clothing elements such that the intensity of fiber processing increases in the direction of drum rotation. The reasons for the random orientation of the fibers in the region of the carding plate according to CH 3452/89 or in the precarding zone of a card are not the same as those for the random orientation of the fibers in the undergrid zone. There is a random orientation in fine cleaning or in the precarding zone because "Just beforehand" (as considered in the direction of rotation of the drum) new material is fed to the swift or the drum. In the undergrid zone, on the other hand, the random orientation does not occur because of the supply of new material, but because of an operative action by a machine element, namely the doffer.

The variation in intensity is preferably achieved by changing the working angle of the clothing, i.e., where the clothing is provided with pins or sawteeth ("tips"), it is achieved by changing the angle between the longitudinal direction of the tips and a predetermined arbitrary reference (e.g. a tangential plane or a radial plane). The said angle is preferably so varied within a predetermined peripheral zone that the "tip" extends in the direction of drum rotation at the start of the region (as considered in the direction of drum rotation) and occurs in opposition to the direction of rotation at the end of the region.

While the invention has been described with reference to the foregoing embodiments, various changes and modifications can be made thereto which fall within the scope of the appended claims.

What is claimed is:

1. A method of fine cleaning or carding textile fibres between a rotating drum of a fine clearing or carding machine and carding elements surrounding the drum and having clothing elements thereon, with the clothing elements on different ones of said carding elements differing from one another, wherein said clothing elements on a first carding element in a group of adjacent carding elements, arranged one following another in the direction of drum rotation, have a working angle which differs from the working angle of the clothing elements on a later carding element in said group in a manner to cause the clothing elements of said first carding element in said group to exert a less severe carding action on said fibers than the clothing elements on said later carding element, so that a effect increases over a predetermined peripheral zone of said drum occupied by said group of adjacent carding elements.

2. A method according to claim 1, wherein said clothing elements are toothed elements and wherein said increase in carding effect is produced by varying the working angle of the clothing elements on different ones of said carding elements.

3. A method according to claim 2, wherein the working angle is changed from a negative carding inclination to a positive carding inclination from said first carding element in said peripheral zone to a later carding element at the trailing end of said peripheral zone as considered in the direction of drum rotation.

4. A method according to claim 1, wherein said peripheral zone is situated in the main carding zone of a card.

5. A method according to claim 1, wherein said zone is located in a fine cleaning machine.

6. A method according to claim 1, wherein the said peripheral zone is situated in the after-carding zone of a card.

7. A method of carding textile fibers between a rotating card drum and carding elements disposed opposite the periphery of said card drum in groups spaced about the circumference of said drum to provide different carding zones, said method comprising increasing the intensity of the carding action exerted on the textile fibers as they pass from the beginning to the end of a peripheral zone situated in an undergrid zone of said card drum by disposing in said undergrid zone a sequence of carding elements each having teeth thereon with the teeth on a first carding element in such undergrid zone exerting a less severe carding action on the fibers than the teeth on a later carding element in such undergrid zone.

8. A method of carding textile fibers between a rotating card drum and carding elements disposed opposite the periphery of said card drum in groups spaced about the circumference of said drum to provide different carding zones, said method comprising increasing the intensity of the carding action exerted on the textile fibers as they pass from the beginning to the end of a peripheral zone in a precarding zone of said card drum by disposing in said precarding zone a sequence of carding elements each having teeth thereon with the teeth on a first carding element in such precarding zone exerting a less severe carding action on the fibers than the teeth on a later carding element is such precarding zone.

9. Carding or fine cleaning apparatus comprising a rotating carding or fine cleaning drum having teeth on its periphery and carding elements adjacent the periphery of said drum, each of said carding elements having a substantially uniform set of clothing elements disposed thereon said the clothing elements of a plurality of adjacent carding elements having different angles of attack.

10. Apparatus according to claim 9, wherein the angles of attack of the clothing elements on a first carding element are such as to produce a less severe carding action and the angles of attack of the clothing elements on a later carding element in the direction of rotation of the drum are such as to produce a more severe carding action, so that the carding of the fibers is increasingly aggressive in the direction of rotation of said drum.

11. Apparatus according to claim 9, wherein said carding elements are movable.

12. Apparatus according to claim 11, wherein said carding elements are revolving flats.

13. Apparatus according to claim 9, wherein said elements are so movable, as a result of the movement, different clothing elements having different angles of attack are disposed in facing relation to said drum.

14. A carding apparatus having a rotating carding drum and, disposed in groups extending therearound, carding elements on which toothed clothing elements are disposed; wherein each of the carding elements of one group presents uniformly shaped toothed clothing elements for contacting fibers passing between such carding elements and said carding drum; wherein, within said one group, the carding elements are stationary; and wherein the toothed clothing elements on a first carding element in said one group to be contacted by the fibers carried by said carding drum exert a less severe carding action on said fibers than the toothed clothing elements on a carding element of said one group which is contacted later by the fibers carried by said carding drum.

15. A carding apparatus having a rotating carding drum and, disposed in groups extending therearound, carding elements on which toothed clothing elements are disposed; wherein each of the carding elements of one group presents uniformly shaped toothed clothing elements for contacting fibers passing between such carding elements and said carding drum; wherein, within said one group, the toothed clothing elements on a first carding element in said one group to be contacted by the fibers carried by said carding drum are inclined in the direction of movement of the carding drum by an amount less than the toothed clothing elements on a later carding element of said one group, so that said first carding element exerts a less severe carding action on said fibers than a carding element of said one group which is contacted later by the fibers carried by said carding drum.

16. Carding apparatus according to claim 15, wherein said clothing elements are saw toothed.

17. Carding apparatus according to claim 15, wherein said one group of carding elements is located in an undergrid zone of said card, and wherein differences in the inclinations of the saw toothed clothing elements on the carding elements of said group are such that a carding action of progressively increasing severity is produced on the fibers passing from the beginning to the end of said undergrid zone.

18. Carding apparatus according to claim 15, including another carding element located in said group so as to be contacted at a still later time by said fibers and having saw toothed clothing elements thereon inclined in the opposite direction from the saw toothed clothing elements on said first carding element.

19. In a method of carding textile fibers between a carding drum and a plurality of elements adjacent said drum having toothed clothing thereon, the improvement comprising disposing adjacent a peripheral zone of said carding drum a group of carding elements to be contacted sequentially by fibers carried by said carding drum as said carding drum rotates, respective ones of said carding elements of said group bearing clothing elements having a working angle different from the working angle of the clothing elements on other carding elements of said group in a manner to cause a first carding element in said group to exert a less severe carding action on said fibers than a later carding element in said group.

* * * * *